US009033062B2

(12) United States Patent
Stratton et al.

(10) Patent No.: US 9,033,062 B2
(45) Date of Patent: May 19, 2015

(54) CONTROL SYSTEM FOR A MACHINE

(71) Applicant: Caterpillar Inc., Peoria, IL (US)

(72) Inventors: Kenneth L. Stratton, Dunlap, IL (US); Kimberly N. Stratton, Sahuarita, AZ (US); Troy K. Becicka, Sahuarita, AZ (US)

(73) Assignee: Caterpillar Inc., Peoria, IL (US)

( * ) Notice: Subject to any disclaimer, the term of this patent is extended or adjusted under 35 U.S.C. 154(b) by 63 days.

(21) Appl. No.: 13/939,225

(22) Filed: Jul. 11, 2013

(65) Prior Publication Data

US 2015/0014003 A1 Jan. 15, 2015

(51) Int. Cl.
*A01B 63/111* (2006.01)
*E02F 9/20* (2006.01)

(52) U.S. Cl.
CPC ..... *E02F 9/2087* (2013.01)

(58) Field of Classification Search
USPC ..... 37/347, 348; 172/2–11; 180/9.4; 414/111, 525.54, 549, 699, 789.7; 701/50, 82
See application file for complete search history.

(56) References Cited

U.S. PATENT DOCUMENTS

| | | | | |
|---|---|---|---|---|
| 5,293,944 | A | 3/1994 | Matsumoto | |
| 5,685,377 | A | 11/1997 | Arstein et al. | |
| 6,317,676 | B1 * | 11/2001 | Gengler et al. | 701/82 |
| 7,658,234 | B2 | 2/2010 | Brandt et al. | |
| 8,083,004 | B2 | 12/2011 | Knight, Jr. | |
| 8,333,248 | B1 | 12/2012 | Sulzer | |
| 8,406,966 | B2 * | 3/2013 | Schedgick et al. | 701/50 |
| 2008/0027610 | A1 * | 1/2008 | Shull | 701/50 |
| 2008/0243345 | A1 | 10/2008 | Knight | |
| 2012/0267128 | A1 | 10/2012 | Shintani et al. | |
| 2013/0000930 | A1 | 1/2013 | Shintani et al. | |

* cited by examiner

*Primary Examiner* — Robert Pezzuto

(57) ABSTRACT

A control system for a machine is disclosed. The system includes a ripper sensor associated with a ripper of the machine configured to generate a signal indicative of a position of the ripper. The system includes a steering command sensor associated with a steering control module of the machine. The steering command sensor is configured to generate a signal indicative of a steering command of the machine. The system further includes a controller configured to receive the signals indicative of the position of the ripper and the steering command of the machine. The controller is configured to execute an action based on the engaged state of the ripper and the steering command of the machine.

20 Claims, 3 Drawing Sheets

CONTROL SYSTEM FOR A MACHINE

TECHNICAL FIELD

The present disclosure relates to a control system for a machine, and more particularly to the control system associated with a ripper of the machine.

BACKGROUND

Mobile excavation machines, such as, for example, track type tractors, motor graders, and scrapers often include one or more material engaging implements utilized to cultivate, dig, or rip a ground surface. The ground surface can include non-homogenous loose soil or compacted material that can be easy or difficult for the machine to process. Further, the implements are required to be handled in such a manner so as to avoid damage of elements of the implement during steering or high speed travel of the machine.

For example, U.S. Pat. No. 8,083,004 relates to a control system for a machine having a power source, a traction device, and a ripping tool. The control system may have a slip sensor configured to generate at least one signal indicative of machine slippage, and at least one actuator operable to position the ripping tool. The control system may also have a controller in communication with the slip sensor, at least one actuator, and the power source. The controller may be configured to receive at least one operator input indicative of an acceptable slip value, and determine actual machine slippage based on at least one signal. The controller may also be configured to directly and separately regulate a speed of the machine and a position of the ripping tool during an excavation process based on the acceptable slip value and actual machine slippage.

SUMMARY

In one aspect, the present disclosure provides a control system for a machine. The system includes a ripper sensor associated with a ripper of the machine. The ripper sensor is configured to generate a signal indicative of a position of the ripper. The system includes a steering command sensor associated with a steering module of the machine. The steering command sensor is configured to generate a signal indicative of a steering command of the machine. The system further includes a controller configured to receive the signals indicative of the position of the ripper and the steering command of the machine. The controller is configured to execute an action based on the engaged state of the ripper and the steering command of the machine.

In another aspect, the present disclosure provides a method for controlling a machine. The method includes receiving a signal indicative of a position of a ripper associated with the machine. The method further includes receiving a signal indicative of a steering command of the machine. The method includes determining if the ripper is in an engaged state based on the position of the ripper. The method further includes executing an action based on the engaged state of the ripper and the steering command of the machine.

In another aspect, the present disclosure provides a machine including a power source, a steering module, a traction device and a ripper. The machine includes a ripper sensor associated with the ripper. The ripper sensor is configured to generate a signal indicative of a position of the ripper. The machine further includes a steering command sensor associated with the steering module. The steering command sensor is configured to generate a signal indicative of a steering command of the machine. The machine further includes a controller configured to receive the signals indicative of the position of the ripper and the steering command of the machine. The controller is configured to execute an action based on the engaged state of the ripper and the steering command of the machine.

DETAILED DESCRIPTION

Reference will now be made in detail to specific embodiments or features, examples of which are illustrated in the accompanying drawings. Generally, corresponding or similar reference numbers will be used, when possible, to refer to the same or corresponding parts.

Figure 1:
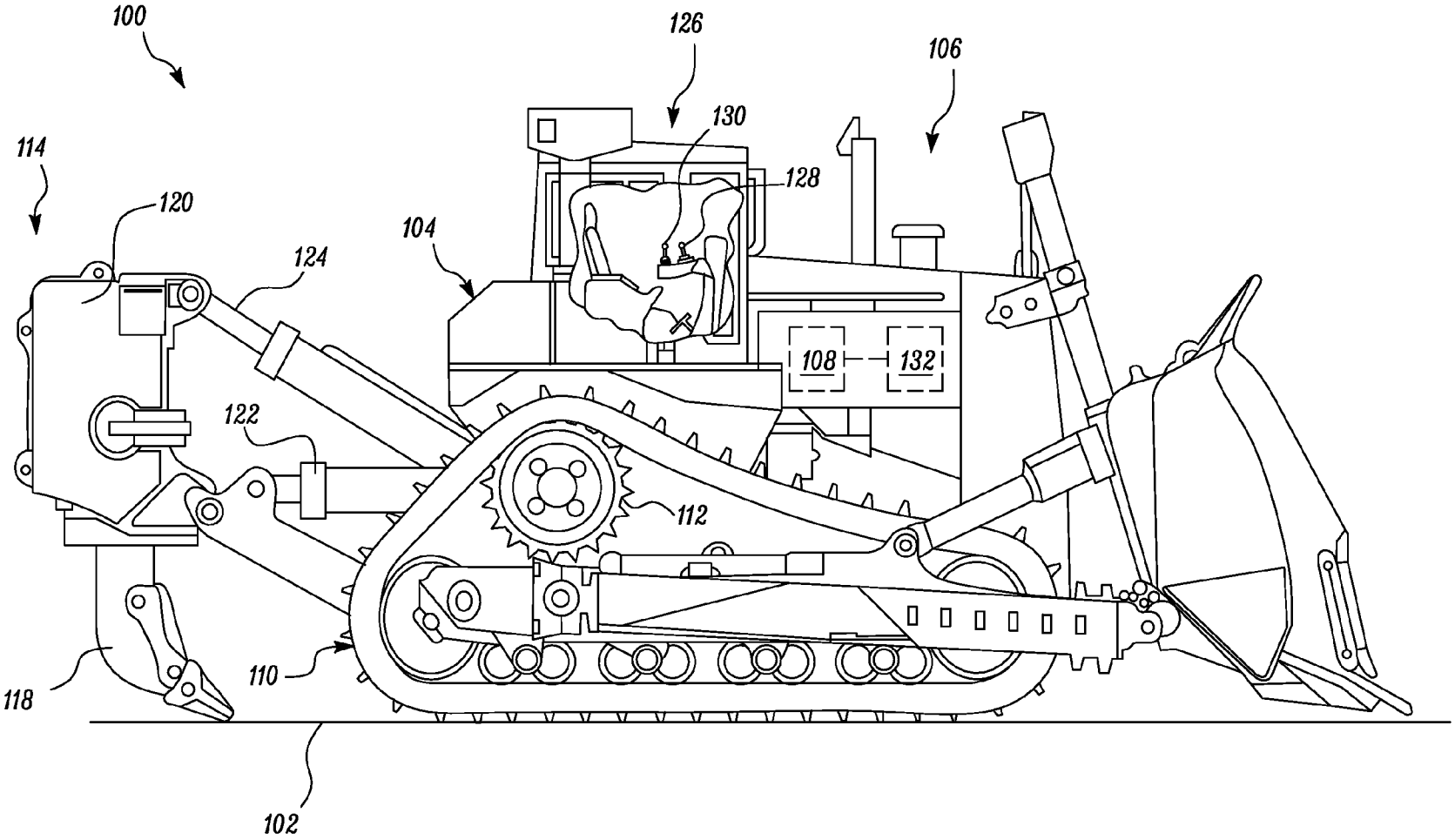
FIG. 1 illustrates a side view of an exemplary machine, according to one embodiment of the present disclosure.

FIG. 1 illustrates a side view of an exemplary machine 100. The machine 100 may be one of various types of machinery used in a number of industries such as mining, agriculture, construction, forestry, waste management, and material handling, among others. For example, the machine 100 may be an earth moving machine such as a motor grader, dozer, a loader, a backhoe, an excavator, or any other earth moving machine. In the illustrated embodiment, the machine 100 includes a track type tractor.

The machine 100 may traverse a work site to manipulate material beneath a work surface 102, e.g. transport, cultivate, dig, rip, and/or execute any other operation known in the art. The machine 100 may include a frame 104. A power source 106 may be housed within an enclosure of the machine 100. The power source 106 is configured to produce mechanical power. The power source 106 may be any type of internal combustion engine such as, for example, a diesel engine, a gasoline engine, or a gaseous fuel-powered engine. Further, power source 106 may be a non-engine type of power producing device such as, for example, a fuel cell, a battery, a motor, or another type of power source known in the art.

The machine 100 may also include a steering control module 108. The machine 100 is provided with a traction device 110 for mobility. The traction device 110 may include tracks located on each side of the machine 100 (only one side shown) and operatively driven by one or more sprockets 112. The sprockets 112 may be operatively connected to the power source 106 to receive power therefrom and drive the traction device 110. The traction device 110 may be hydraulically actuated, mechanically actuated, electronically actuated, or actuated in any other suitable manner. Movement of the traction device 110 may propel the machine 100 with respect to the work surface 102. Further, a relative motion of the tracks may cause a change in a direction of the steering of the machine 100. Alternatively, the traction device 110 may additionally or alternately include wheels, belts, or other traction devices.

Further, the machine 100 includes a ripper 114 provided at one end of the machine 100. In an embodiment, the ripper 114 may be capable of movement. More specifically, the ripper 114 is configured to lift, lower, and may tilt relative to the frame 104. The ripper 114 may include a shank 118 held in place by a mounting member 120. The shank 118 may penetrate the work surface 102 to disturb or disrupt (i.e. rip) the material below the work surface 102. The shank 118 may be capable of movement relative to the mounting member 120. Further, the shank 118 may have several configurations relative to the mounting member 120. For example, the shank 118 may be moved to positions higher, lower, away from, or towards the frame 104 of the machine 100.

The mounting member 120 may be connected to the frame 104 of the machine 100 via a linkage system. The term "linkage system" used herein refers to the ripper 114 and other components associated with the ripper 114. In the illustrated embodiment, a first hydraulic actuator 122 is connected to the ripper 114, in order to lift and lower the ripper 114. Also, a second hydraulic actuator 124 is connected to the ripper 114, in order to tilt the ripper 114. It is contemplated that ripper 114 may alternatively include a plow, a tine, a cultivator, and/or any other task-performing device known in the art based on the application.

The movement of the ripper 114 may correspond to a plurality of predetermined locations and/or orientations (i.e. angle settings of the shank 118). For example, the shank 118 may have a discrete penetration angle and a discrete dig angle that may change based on a material composition of the work surface 102, a size or capacity of the machine 100, and/or the configuration of the shank 118 relative to the mounting member 120. In one example, the penetration angle of the shank 118 may be vertical relative to the work surface 102, to facilitate efficient penetration of the work surface 102. In order to maintain this vertical angle for the different configurations each of the available shank configurations, the first and second hydraulic actuators 122, 124 of the mounting member 120 may need to be adjusted based on the current shank configuration.

The machine 100 may also include an operator station 126. An operator may control the operation of the ripper 114 via controls present within the operator station. The controls may include, but not limited to, a ripper control 128 and a steering control 130. The ripper control 128 may allow the operator to set a height of the shank 118 above or below the work surface 102 and/or set an angle of the shank 118 relative to the work surface 102. The steering control 130 may further be connected to a steering control module 108. The steering control module 108 may be configured to control the steering of the machine 100. Although the ripper control 128 and the steering control 130 are shown as joysticks in the accompanying drawings, the controls may alternatively include push buttons, a touch screen control, voice control, steering wheel, switches and knobs. The operator station 126 may additionally include other controls such as, an acceleration pedal, a deceleration pedal or any other control devices known in the art.

In one embodiment, the ripper control 128 and the steering control 130 may be operatively connected to a controller 132. In the present disclosure, the controller 132 is configured to receive the inputs from the operator via the ripper control 128 and the steering control 130. The controller 132 is configured to determine when the operator attempts to steer the machine 100, when the ripper 114 is in an engaged state. The working of the controller 132 will be described in detail in connection with FIG. 2.

Figure 2:
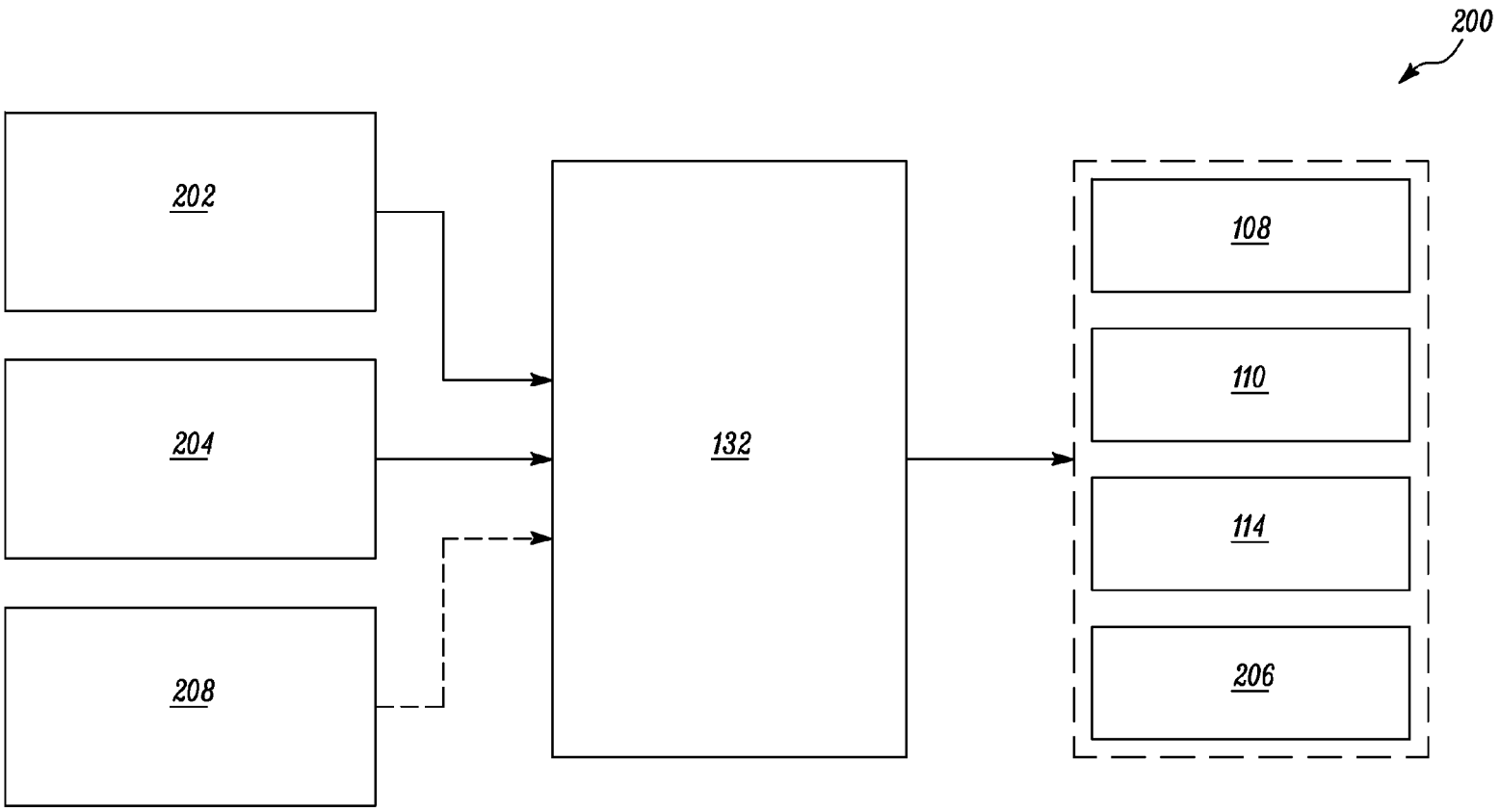
FIG. 2 illustrates a block diagram for a control system of the machine.

FIG. 2 illustrates a control system 200 for the machine 100, according to an embodiment of the present disclosure. The control system 200 may include a steering command sensor 202 associated with the steering control module 108 of the machine 100. The steering command sensor 202 generates a signal indicative of a steering command of the machine 100. The steering command may be an operator command or an automated control systems input. In an embodiment, the steering command may be a desired steering change or the desired yaw-rate of the machine 100. In an aspect of the present disclosure, the steering command sensor 202 is configured to determine the desired change in steering angle between the traction device 110 and a travel direction of the machine 100. The steering command sensor 202 may be communicably coupled to the controller 132. The controller 132 is configured to receive the signal generated by the steering command sensor 202 indicative of the desired steering change or a desired steering control effort of the machine 100.

The control system 200 may further include a ripper sensor 204 associated with the ripper 114 of the machine 100. The ripper sensor 204 is configured to generate a signal indicative of the position of the ripper 114. The ripper sensor 204 may include at least one of a position sensor, a pressure sensor, a pin sensor, a flow sensor and a rotary sensor. In one embodiment, the ripper sensor 204 may be associated with the first and second hydraulic actuators 122, 124. The ripper sensor 204 may be positioned adjacent to and/or within the first and second hydraulic actuators 122, 124. In one embodiment, the pressure sensors provided on the ripper 114 may include strain gauges. The strain gauges may be configured to detect a torsional strain associated with the ripper 114. The ripper sensor 204 is configured to generate a signal indicative of an extension of the first and second hydraulic actuators 122, 124. It is contemplated that the signal generated by the ripper sensor 204 may represent values proportional to a lift and a tilt of the ripper 114. In another embodiment, the ripper sensor 204 may estimate the positions of the first and the second hydraulic actuators 122, 124 based on a hydraulic model of the ripper 114. The hydraulic model of the ripper 114 may include an integration of a hydraulic fluid metered into the actuator. Further, the hydraulic model may also include a sensed pressures of the first and second hydraulic actuators 122, 124. The ripper sensor 204 is communicably coupled to the controller 132.

The controller 132 receives the signal indicative of the position of the ripper 114 from the ripper sensor 204. In one embodiment, the controller 132 may compare the position of the ripper 114 with a predetermined threshold. In another embodiment, the controller 132 is communicably coupled to a database (not shown). The database is configured to store an actual ground elevation of the machine 100. The predetermined thresholds are adjusted based on the actual ground elevation as stored in the database. A person ordinarily skilled in the art will appreciate that the database may be any conventional or non-conventional database known in the art, like an oracle-based database. Moreover, the database may be capable of storing and/or modifying pre-stored data as per operational and design needs. In one embodiment, the database may be extrinsic to the machine 100 and located at a remote location away from the machine 100. Alternatively, the database may be intrinsic to the machine 100.

The controller 132 is configured to retrieve the predetermined threshold from the database and compare the position of the ripper 114 with the predetermined threshold. The controller 132 may determine the engaged state of the ripper 114 if the position of the ripper 114 is lower than the predetermined threshold. In another embodiment, the controller 132 may determine the engaged state of the ripper 114 based on a user command issued by the operator.

In one embodiment, the controller 132 is configured to execute any one or a combination of actions based on the comparison of the position of the ripper 114 with the predetermined threshold. More particularly, the controller 132 executes the action if the ripper 114 is determined to be in the engaged state and the operator attempts to steer the machine 100. The controller 132 may determine that the operator is attempting to steer the machine 100 based on the signal received from the steering command sensor 202.

One of the actions may include alerting the operator of the above mentioned scenario. Accordingly, the controller 132 is coupled to an output unit 206. The output unit 206 is configured to provide a feedback to the operator based on the engagement of the ripper 114 with the work surface 102 and the steering command of the machine 100. In one embodiment, the output unit 206 may further indicate duration of the steering. The alerting means may include, but not limited to, a display unit or an indicator light. The indicator light of different colors, may be indicative of different states of engagement of the ripper, for example, a red light may indicate that the ripper is in the engaged state. In another embodiment, the alerting means may include an auditory output device, for example, a speaker. Accordingly, based on the alert, the operator may stop or disable steering via the steering control 130, when the ripper 114 is in the engaged state.

In another embodiment, the action includes controlling of the steering of the machine 100 by the controller 132. The controller 132 may compare the steering command of the machine 100 with a threshold. Based on the comparison, the controller 132 may determine if the steering command of the machine 100 exceeds the threshold and subsequently limit the steering of the machine 100. In this case, the controller 132 is coupled to the steering control module 108. The controller 132 is configured to send a control signal to the steering control module 108, based on the determination of the ripper 114 in the engaged state and the steering command of the machine 100, in order to control or disable the steering of the machine 100.

In yet another embodiment, the action may include controlling the position of the ripper 114. In such a situation, the controller 132 issues a control signal to the ripper 114. The ripper 114 may be disengaged from the work surface 102, in order to allow the machine 100 to be steered. For example, the controller 132 may control a fluid supplied to the first and second actuators 122, 124 associated with the ripper 114 in order to change the position of the ripper 114.

Further, the action may also include controlling a speed of the machine 100. Accordingly, as shown in FIG. 2, the control system 200 may optionally include a speed sensor 208 communicably coupled to the controller 132. The speed sensor 208 is configured to generate a signal indicative of the speed of the machine 100. The speed sensor 208 may sense the speed of the power source, the drive train or the traction device 110 with respect to the machine 100. The speed sensor 208 may be positioned adjacent a driven component associated with the traction device 110, like the sprocket 112. The speed sensor 208 may embody any type of motion or speed sensing sensor such as, a hall sensor, a rotation sensor, a Doppler radar, a Doppler GPS, an optical motion detector, or any other known sensor.

The controller 132 is configured to receive the signal indicative of the speed of the machine 100 from the speed sensor 208. The controller 132 compares the speed of the machine 100 with a threshold. The controller 132 is further configured to determine if the speed of the machine 100 exceeds the respective threshold limit. Further, the controller 132 is configured to execute the action by sending a control signal to the traction device 110 based on the engaged state of the ripper, the steering angle of the machine 100 and/or the speed of the machine 100.

The controller 132 may embody a single microprocessor or multiple microprocessors that include a means for controlling the machine 100 during steering of the machine 100. For example, the controller 132 may include a memory, a secondary storage device, and a processor, such as a central processing unit or any other means for controlling machine 100. Numerous commercially available microprocessors can be configured to execute the functions of controller 132. It should be appreciated that controller 132 could readily embody a general power source microprocessor capable of controlling numerous power source functions.

INDUSTRIAL APPLICABILITY

During the steering of the machine 100, the ripper 114 and its associated components provided at the rear end of the machine 100 may get damaged or wear due to increased turning forces or load on the ripper 114, specifically when the ripper 114 is engaged within the work surface 102. Generally, the operator manually checks if the ripper 114 is engaged within the work surface 102 prior to the steering of the machine 100. This may not be an easy task for an operator as he may forget over the course of operating shift.

In the present disclosure, the controller 132 is configured to determine the engaged state of the ripper 114 and execute one or a combination of different actions when the operator attempts to steer the machine 100, with the ripper 114 still engaged within the work surface 102. The actions may include alerting the operator, controlling the position of the ripper 114, controlling the steering of the machine 100 and/or controlling the speed of the machine 100.

Figure 3:
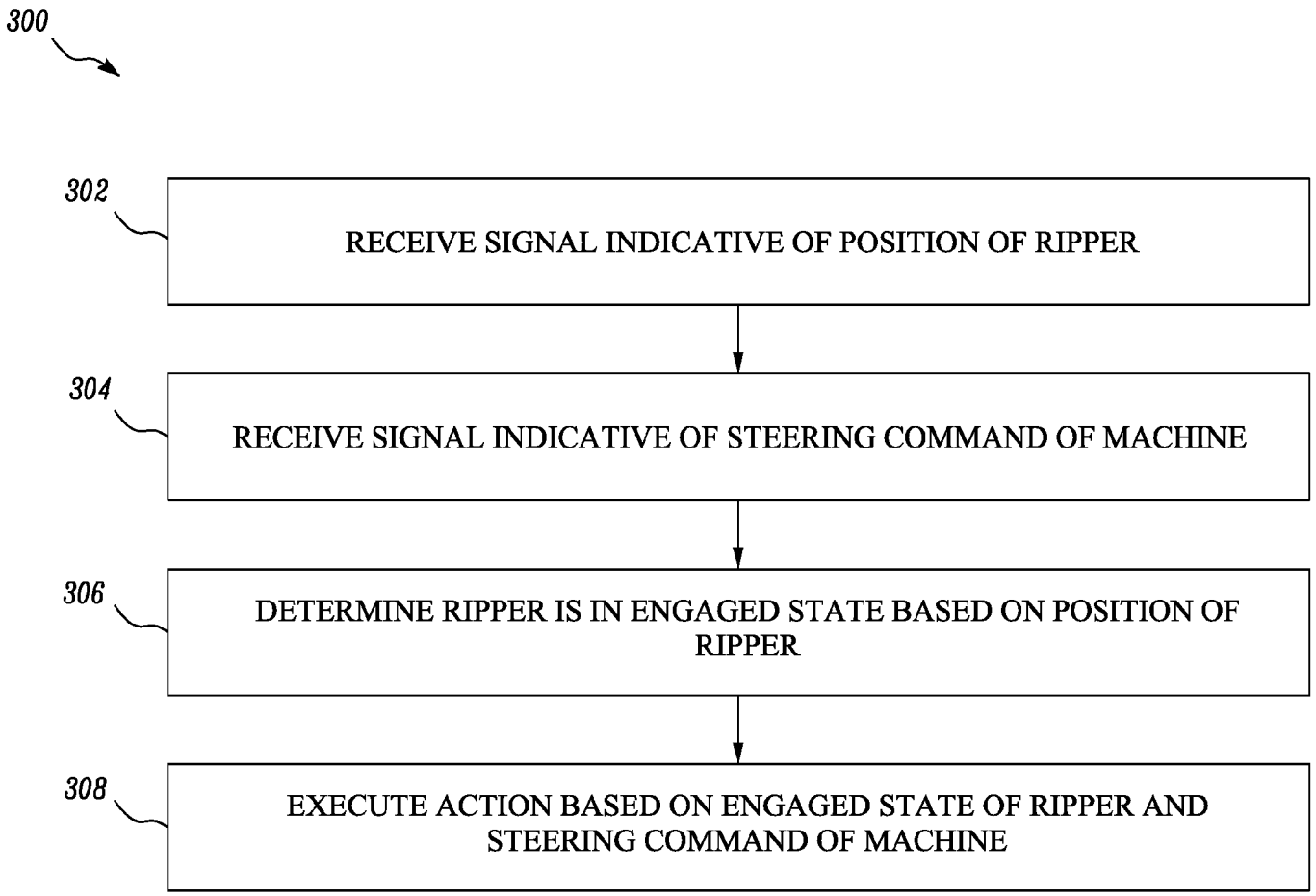
FIG. 3 illustrates a method for controlling the machine.

FIG. 3 illustrates a method 300 for controlling the machine 100. At step 302, the controller 132 receives the signal indicative of the position of the ripper 114 from the ripper sensor 204. At step 304, the controller 132 receives the signal indicative of the steering command of the machine 100 from the steering command sensor 202. Optionally, the controller 132 may also receive the signal indicative of the speed of the machine 100 from the speed sensor 208.

At step 306, the controller 132 determines if the ripper 114 is in the engaged state based on the position of the ripper 114. In one embodiment, the controller 132 may determine the engaged state of the ripper 114 based on the comparison of the position of the ripper 114 with the predetermined threshold. In another embodiment, the user command may be indicative of the engaged state of the ripper 114.

At step 308, the controller 132 may execute any one or combination of the actions based on the engaged state of the ripper 114 and the steering command of the machine 100. The action may include alerting the operator via the output unit 206 based on the engaged state of the ripper 114 and the steering command of the machine 100. Based on the alert, the operator may disable the steering of the machine 100 via the steering control 130 in order to avoid damaging the ripper 114 and its associated components. The action may also include controlling the movement of the ripper 114. The controller 132 may issue the control signal to the ripper 114 for changing the position of the ripper 114. Moreover, the ripper 114 may be disengaged from the work surface 104 in order to prevent the damage.

Other actions may include controlling the steering and/or the speed of the machine 100. The controller 132 may compare the steering command and the speed of the machine 100 with the respective thresholds, in order to determine if the steering command or the speed of the machine 100 exceeds the respective threshold limits when the ripper 114 is in the engaged state. The controller 132 sends the appropriate control signal to the steering control module 108 and/or the traction device 110 to control the steering command and/or the speed of the machine 100 respectively.

It will be apparent to those skilled in the art that various modifications and variations can be made to the disclosed method of assembling fuel pump on the engine without departing from the scope of the disclosure. Other embodiments of the present disclosure will be apparent to those skilled in the art from consideration of the specification and practice of the system disclosed herein. It is intended that the specification and examples be considered as exemplary only, with a true scope of the disclosure being indicated by the following claims and their equivalents.

From the foregoing, it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. A control system for a machine, the system comprising:

a ripper sensor associated with a ripper of the machine, the ripper sensor configured to generate a signal indicative of a position of the ripper;

a steering command sensor associated with a steering control module, the steering command sensor configured to generate a signal indicative of a steering command of the machine; and a controller communicably coupled to the ripper sensor and the steering command sensor, the controller configured to:

receive the signal indicative of the position of the ripper;

receive the signal indicative of the steering command of the machine;

determine if the ripper is in an engaged state based on the position of the ripper; and execute an action based on the engaged state of the ripper and the steering command of the machine.

2. The system of claim 1, wherein the action comprises alerting an operator based on the engaged state of the ripper and the steering command of the machine.

3. The system of claim 1, wherein the ripper sensor include at least one of a position sensor, a pressure sensor, a pin sensor, a rotary sensor and a flow sensor.

4. The system of claim 1, wherein the ripper sensor is configured to determine an estimated position of the ripper based on a hydraulic model of the ripper and an estimated hydraulic flow.

5. The system of claim 1, wherein the controller is further configured to compare the position of the ripper with a threshold to determine if the ripper is in the engaged state.

6. The system of claim 5, wherein the action comprises controlling a movement of the ripper based on the determination.

7. The system of claim 1 further comprising a speed sensor communicably coupled to the controller, the speed sensor configured to generate a signal indicative of speed of the machine.

8. The system of claim 7, wherein the controller is further configured to determine if at least one of the steering command and the speed of the machine exceed respective threshold limits.

9. The system of claim 8, wherein the action comprises controlling at least one of the steering command and the speed of the machine based on the determination.

10. A method for controlling a machine, the method comprising:

receiving a signal indicative of a position of a ripper associated with the machine;

receiving a signal indicative of a steering command of the machine;

determining if the ripper is in an engaged state based on the position of the ripper; and executing an action based on the engaged state of the ripper and the steering command of the machine.

11. The method of claim 10, wherein executing the action comprises alerting an operator based on the engaged state of the ripper and the steering command of the machine.

12. The method of claim 10, wherein determining if the ripper is in the engaged state further comprises comparing the position of the ripper with a threshold.

13. The method of claim 12 further comprising controlling a movement of the ripper based on the determination and the engaged state of the ripper.

14. The method of claim 10 further comprising receiving a signal indicative of speed of the machine.

15. The method of claim 14 further comprising:

determining if at least one of the steering command and the speed of the machine exceed respective threshold limits; and controlling at least one of the steering command or the speed of the machine based on the engaged state of the ripper, if the respective threshold limit is exceeded.

16. A machine comprising:

a power source;

a steering module;

a traction device;

a ripper;

a ripper sensor associated with the ripper, the ripper sensor configured to generate a signal indicative of a position of the ripper;

a steering command sensor associated with the steering control module, the steering command sensor configured to generate a signal indicative of a steering command of the machine; and a controller communicably coupled to the ripper sensor and the steering command sensor, the controller configured to:

receive the signal indicative of the position of the ripper;

receive the signal indicative of the steering command of the machine;

determine if the ripper is in an engaged state based on the position of the ripper; and execute an action based on the engaged state of the ripper and the steering command of the machine.

17. The machine of claim 16, wherein the action comprises alerting an operator based on the engaged state of the ripper and the steering command of the machine.

18. The machine of claim 16, wherein the controller is further configured to:

compare the position of the ripper with a threshold to determine if the ripper is in the engaged state; and controlling a movement of the ripper based on the determination.

19. The machine of claim 16 further comprising a speed sensor communicably coupled to the controller, the speed sensor configured to generate a signal indicative of speed of the machine.

20. The machine of claim 19, wherein the controller is further configured to:

determine if at least one of the steering command and the speed of the machine exceed respective threshold limits; and controlling at least one of the steering command and the speed of the machine based on the determination and the engaged state of the ripper.

* * * * *